US005228266A

United States Patent [19]

Focke

[11] Patent Number: 5,228,266

[45] Date of Patent: Jul. 20, 1993

[54] APPARATUS FOR SUPPORTING AND GUIDE HINGE-LID PACKS FOR THE GLUING OF SIDE TABS

[75] Inventor: Heinz Focke, Verden, Fed. Rep. of Germany

[73] Assignee: Focke & Co., (GmbH & Co.), Verden, Fed. Rep. of Germany

[21] Appl. No.: 804,743

[22] Filed: Dec. 11, 1991

[30] Foreign Application Priority Data

Dec. 22, 1990 [DE] Fed. Rep. of Germany ..... 4041599

[51] Int. Cl.[5] ..... B65B 51/02

[52] U.S. Cl. ..... 53/383.1; 53/387.2; 493/132

[58] Field of Search ..... 53/383.1, 387.2; 493/131, 132, 178, 179

[56] References Cited

U.S. PATENT DOCUMENTS

| | | | |
|---|---|---|---|
| 2,209,111 | 7/1940 | Chalmers | 53/579 X |
| 2,216,884 | 10/1940 | Kott | 53/383.1 X |
| 2,263,739 | 11/1941 | Rose | 53/387.2 |
| 3,145,518 | 8/1964 | Ricca | 53/387.2 |
| 3,299,854 | 1/1967 | Van Loben Sels . | |
| 3,518,805 | 7/1970 | Udall | 493/132 X |
| 4,084,393 | 4/1978 | Focke | 53/207 |
| 4,708,704 | 11/1987 | Focke et al. | 493/151 |
| 4,753,384 | 6/1988 | Focke et al. . | |

FOREIGN PATENT DOCUMENTS

| | | |
|---|---|---|
| 391118 | 10/1990 | European Pat. Off. . |
| 1052300 | 3/1959 | Fed. Rep. of Germany . |
| 1096022 | 12/1960 | Fed. Rep. of Germany . |
| 1104807 | 4/1961 | Fed. Rep. of Germany . |
| 1284349 | 11/1968 | Fed. Rep. of Germany . |
| 2440006 | 3/1976 | Fed. Rep. of Germany . |
| 3108089 | 1/1987 | Fed. Rep. of Germany . |
| 3536791 | 4/1987 | Fed. Rep. of Germany . |
| 3725845 | 2/1988 | Fed. Rep. of Germany . |
| 1514567 | 1/1968 | France . |
| 455362 | 2/1968 | Switzerland . |
| 1173966 | 12/1969 | United Kingdom . |
| 2017627 | 10/1979 | United Kingdom . |
| 2063811 | 6/1981 | United Kingdom . |

*Primary Examiner*—John Sipos

*Attorney, Agent, or Firm*—Sughrue, Mion, Zinn, Macpeak & Seas

[57] ABSTRACT

In the production of hinge-lid packs, outer side tabs (15) and lid side tabs (16) have to be provided with glue when they are in a horizontally directed intermediate position. For this purpose, the hinge-lid packs (10) are fed along a pack track (19) to a gluing unit (20). In order to accurately position the side tabs (15) and lid side tabs (16), stationary guide rails (28, 29) are provided and the side tabs slide along these rails in a horizontally directed position. The pack track (19) is provided with further guide member for the hinge-lid pack (10) and for the laterally projecting side tabs and lid side tabs.

11 Claims, 4 Drawing Sheets

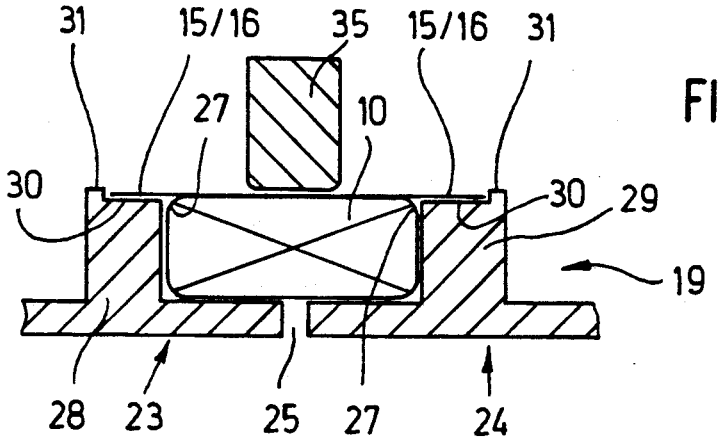
FIG.4
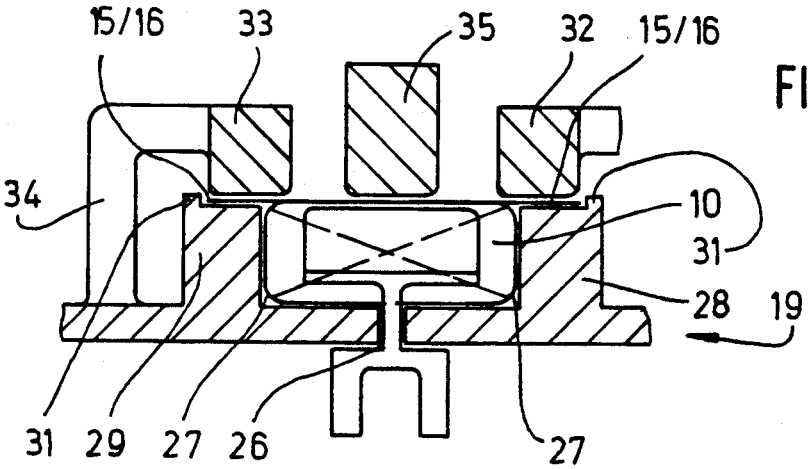
FIG.5
FIG.6
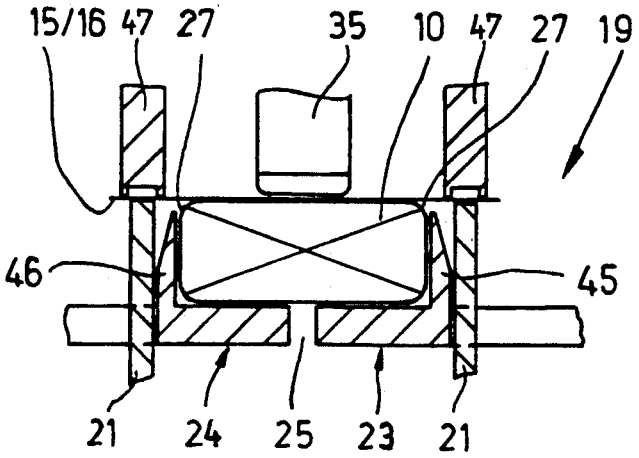

APPARATUS FOR SUPPORTING AND GUIDE HINGE-LID PACKS FOR THE GLUING OF SIDE TABS

BACKGROUND OF THE INVENTION

The invention relates to an apparatus for producing hinge-lid packs, especially with rounded or bevelled longitudinal edges, which packs are feedable on a pack track to a gluing unit for the application of glue to laterally directed outer side tabs (side tabs, lid side tabs) forming parts of pack side panels, said horizontally directed side tabs and lid side tabs being supported by guides.

Hinge-lid packs for cigarettes and the like are usually designed such that side panels of a box part and of a lid are made from side tabs or lid side tabs which are adhesively bonded to one another. Normally, the side tabs are connected with a box front panel and the lid side tabs with a lid front panel. The glue is applied to the inner side of the outer side tabs and lid side tabs.

To apply the glue onto the downwardly facing inner sides of the side tabs and lid side tabs, these tabs remain in a horizontally directed position when the almost completely folded and already filled hinge-lid pack leaves a folding turret or another folding means. The folding turret is followed in the radial direction by a rectilinear pack track. In the region of this pack track, glue is applied to the downwardly facing sides of the side tabs and lid side tabs which are essentially directed horizontally (U.S. Pat. No. 4,084,393).

If the respective side tabs have been pre-folded or pre-shaped in the course of the preceding folding steps, it is particularly difficult to orient the side tabs and/or lid side tabs in the gluing position. This pre-shaping of side tabs is mostly found in hinge-lid packs with rounded or bevelled longitudinal edges (U.S. Pat. No. 4,708,704). Pre-shaping results in an inclined position of the side tabs and this position is unfavourable for the application of glue.

SUMMARY OF THE INVENTION

The invention is based on the object to design an apparatus for producing hinge-lid packs in such a way that glue can be applied to laterally projecting side tabs and lid side tabs of hinge-lid packs in a perfect manner.

To attain this object, the apparatus according to the invention is characterized in that stationary guide rails serving as lateral guides of the pack track each form an upper supporting surface acting as a bearing surface for the side tabs and lid side tabs and comprise lateral guide ribs for the lateral edges of said tabs.

The apparatus according to the invention therefore comprises stationary guide rails arranged along the pack track and serving as lateral guides for the side tabs and lid side tabs. The guide rails comprise an upper supporting surface which acts as a bearing surface and retains the side tabs and lid side tabs in an (approximately) horizontal position, in which glue can be applied in a known manner to the side tabs and lid side tabs from below by means of glue rollers. The guide rails according to the invention additionally comprise lateral guide ribs for a lateral delimitation of the pack track. These guide ribs secure the packs in the region of the side tabs and lid side tabs against laterally directed relative movements.

According to a further feature of the invention, an upper guide is provided to ensure a correct positioning of the hinge-lid pack in the region of the pack track. This upper guide preferably extends above the hinge-lid packs approximately in the longitudinal centre region of said packs. This strip-like upper guide extends over and beyond a gluing unit.

According to a still further feature of the invention, an upper counter guide for the projecting side tabs or lid side tabs is arranged at least in a region of the pack track which is confronting the gluing unit, so that said tabs are guided practically on all sides and pass through the gluing unit in a very precise relative position.

Further features of the invention are concerned with the structure of the pack track and the arrangement of the gluing unit in the region of the pack track. An exemplary embodiment of the invention will be described below in detail with reference to the drawings, in which:

BRIEF DESCRIPTION OF THE DRAWINGS

FIG. 4 is a cross-section of the pack track taken along the line IV—IV of FIG. 2, FIG. 5 is a cross-section of the pack track taken along the line V—V of FIG. 2 and FIG. 6 is a cross-section of the pack track taken along the line VI—VI of FIG. 2.

DESCRIPTION OF A PREFERRED EMBODIMENT

Figure 1:
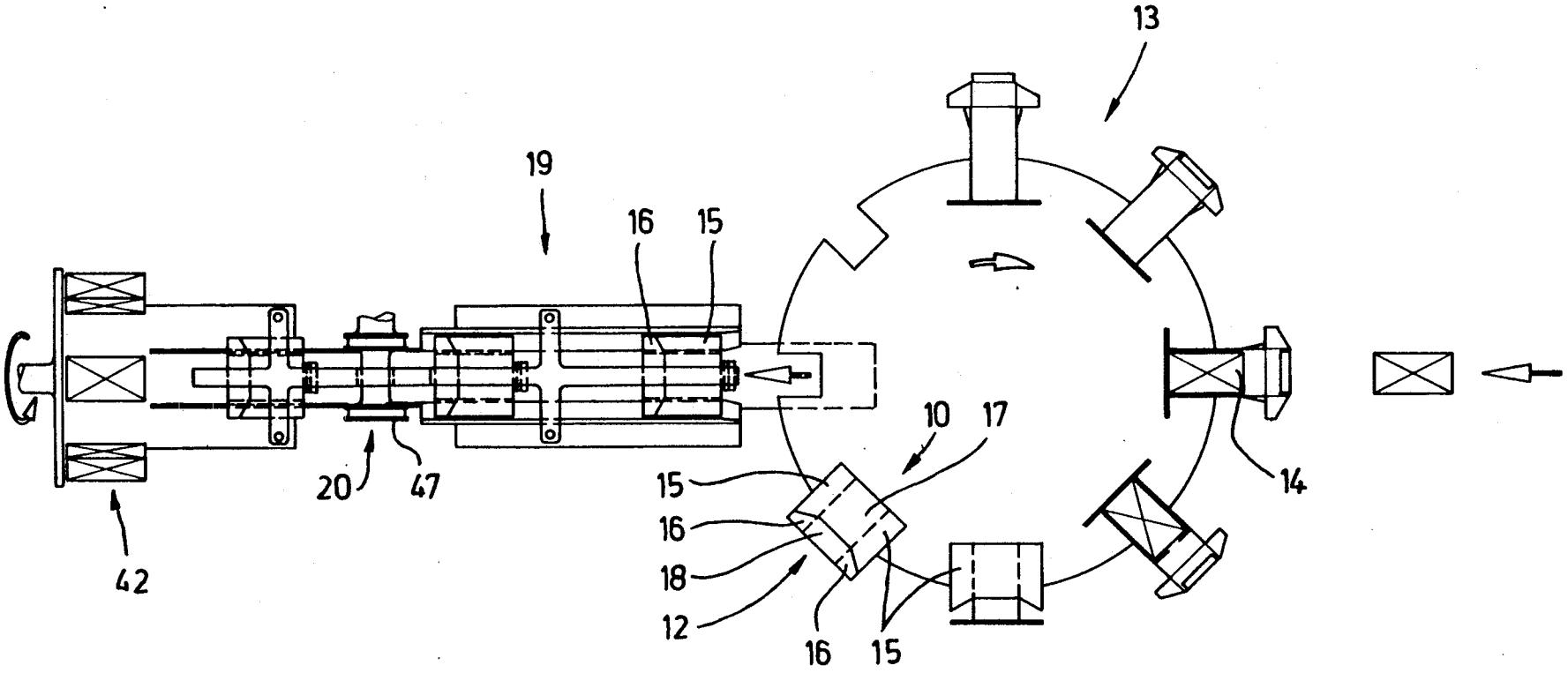
FIG. 1 is a schematic plan view of part of a packaging machine with a pack track following a folding turret.
Figure 2:
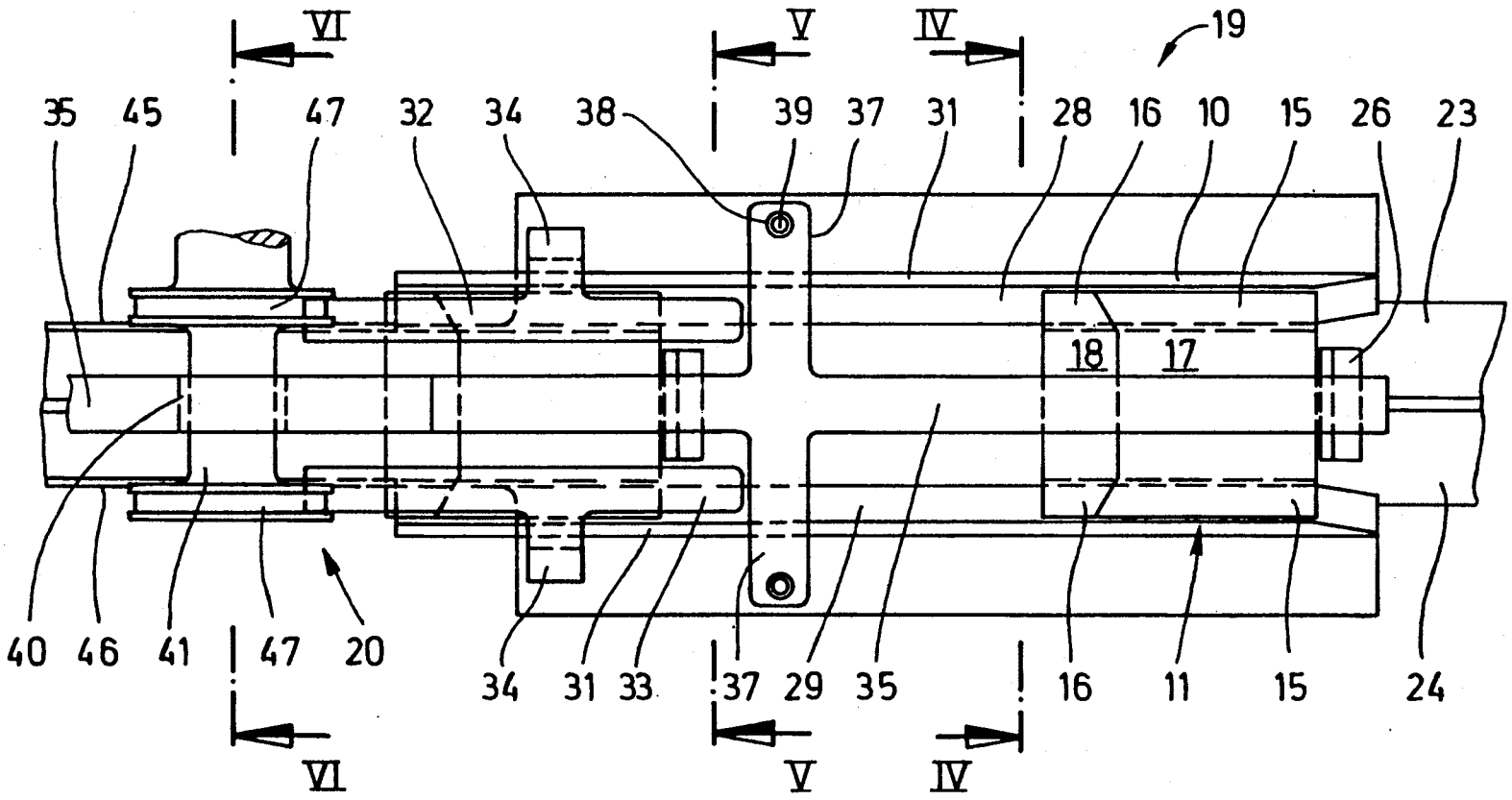
FIG. 2 is a fragmentary plan view of the pack track on an enlarged scale.

The details illustrated in the drawings form part of a packaging machine for producing and filling hinge-lid packs 10. This type of pack is particularly known for holding cigarettes. The hinge-lid pack 10 normally comprises a box part 11 and a lid 12 (FIGS. 1 and 2). Each side panel of these hinge-lid packs 10 comprises folding tabs which are folded on top of one another and are adhesively bonded. Inner side tabs and lid side tabs are connected with a rear panel of the box part 11 and a rear panel of the lid. These inner side tabs are folded into the proper pack position (abutting the pack contents, i.e. a cigarette block 14) in the region of a folding turret 13 (FIG. 1). Outer side tabs 15 and lid side tabs 16 are connected with a box front panel 17 and a lid front panel 18, respectively. To adhesively bond these outer side tabs 15, 16 with the already folded inner side tabs, glue is applied to the bottom sides of the side tabs 15 and 16 while they are located in a horizontally directed position, particularly in the plane of box front panel 17 and lid front panel 18. Subsequently, the tabs 15 and 16 are folded over.

In the present embodiment, the folding turret 13 is designed as shown and described in U.S. Pat. No. 4,084,393. The nearly completed hinge-lid packs 10 leave the folding turret 13 in a radial direction and thus directly enter a rectilinear pack track 19 (FIGS. 1–6) which follows the folding turret 13.

Glue is applied to the side tabs 15 and lid side tabs 16 in the region of the pack track 19 by means of a gluing unit 20 (FIG. 1–3) which, in the present embodiment, comprises lateral glue discs 21 which immerse into a glue vessel 22. The rotatably driven glue discs 21 apply glue to the downwardly facing inner side of the side tabs 15 and lid side tabs 16. Above these glue discs 21, there are arranged counter discs 47 which also rotate and which contact the upper side of the horizontally directed side tabs 15 and lid side tabs 16.

The pack track 19 comprises two support rails 23, 24 on which the hinge-lid packs 10 rest in a sliding manner during transport. The support rails 23, 24 are spaced apart from one another, such that a central longitudinal slit 25 (FIGS. 2 and 4–6) is formed. Pushers 26 of a chain conveyor pass through this slit. The pushers 26 engage the hinge-lid packs 10 at their rear sides, i.e. in the region of bottom faces, and convey the hinge-lid packs 10 along the pack track 19.

For the application of glue, the side tabs 15 and lid side tabs 16 have to adopt a relative position within the pack track 19 which is as accurate as possible and, most importantly, horizontally directed. In the case of hinge-lid packs 10 with pre-shaped side tabs 15 and lid side tabs 16, this is difficult to achieve, especially in the case of packs with rounded or bevelled longitudinal edges 27 and correspondingly pre-shaped side tabs (U.S. Pat. No. 4,753,383 and U.S. Pat. No. 4,753,384).

To secure this position, lateral guides for the side tabs 15 and lid side tabs 16 are provided in the region of the pack track 19. In the embodiment illustrated, lateral guide rails 28, 29 are disposed directly next to the path of motion of the hinge-lid packs 10. In the present embodiment, these guide rails 28, 29 are integrated into the section shape of the pack track 19, particularly of the support rails 23, 24. The guide rails 28, 29 are arranged in such a way that they form an exact lateral guide of the hinge-lid packs 10. Of particular importance, however, is an upper supporting surface 30 of the guide rails 28, 29. These supporting surfaces 30 serve for contacting and supporting the horizontally directed side tabs 15 and lid side tabs 16. Each supporting surface 30 therefore extends on a level with the front side of the hinge-lid pack 10 (box front panel 17, lid front panel 18). The side tabs 15, 16 slide on the supporting surfaces 30 during transport.

Moreover, the guide rails 28, 29 are provided with lateral guides for the side tabs 15 and lid side tabs 16. In the present embodiment, a lateral guide rib 31 is arranged on the top side of each of the guide rails 28, 29. The lateral edges of the side tabs 15 and lid side tabs 16 can bear on these guide ribs 31.

To further secure the exact position of the hinge-lid pack 10 in the region of the pack track 19, an upper guide for the side tabs 15 and lid side tabs 16 is disposed in a region confronting the gluing unit 20. This upper guide comprises rod-shaped elongate guide members 32, 33 (FIGS. 2–4) which extend above the guide rails 28, 29 and are stationary. The guide members 32, 33 are slightly offset to the inside relative to the guide rails 28, 29 and therefore extend above the edge portion of the hinge-lid pack 10. The guide members 32, 33 are connected with the support rails 23, 24 of the pack track 19 via angular supporting pieces 34.

A further upper guide is disposed in the centre region of the pack track 19. A guide web 35 (FIGS. 2–6) extends above the path of motion of the hinge-lid packs 10, such that the packs are secured against undesired upward movements. The guide web 35 is mounted on lateral supports 36, such that the guide web 35 bears under gravity against the top side of the hinge-lid pack 10 while the pack is transported in the pack track 19. The guide web 35 can be lifted off the supports 36 (FIG. 3), which means it is not anchored at the top. Instead, lateral supporting arms 37 (FIGS. 2 and 3) are provided with orifices 38, and a pin 39, which is located on the top side of the supports 36, freely enters each orifice 38.

The guide web 35 extends over and beyond the gluing unit 20. In the region of the gluing unit, a recess 40 (FIGS. 2 and 3) is formed so that a shaft 41 of the counter discs 47 can pass through.

Figure 3:
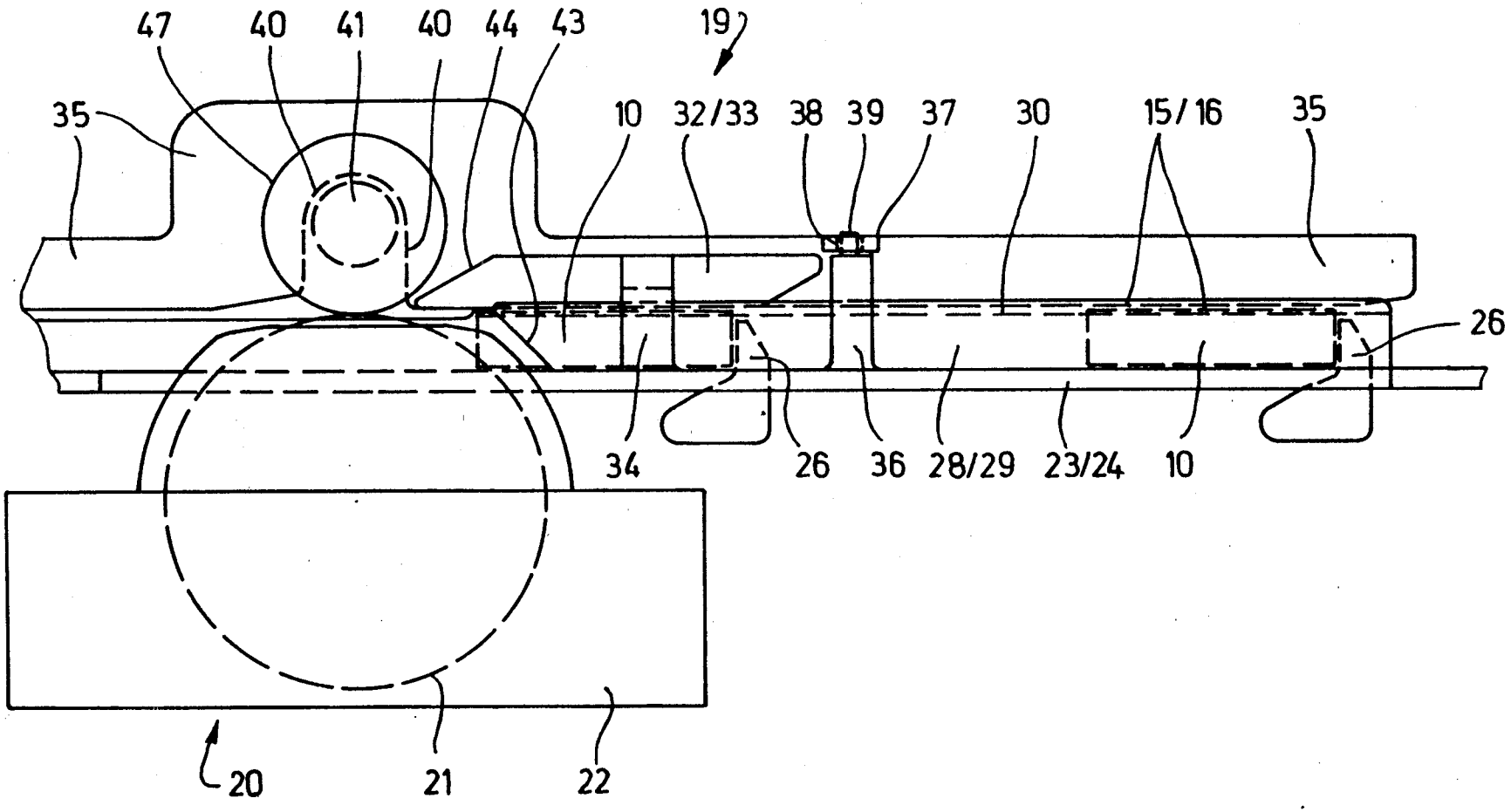
FIG. 3 is a side view of the detail of FIG. 2.

The lateral guides, i.e. the guide rails 28, 29 extend directly up to the gluing unit 20, such that the side tabs 15 and lid side tabs 16 are introduced into the gluing unit 20, in particular between glue discs 21 and counter discs 47, without changing their exact relative position. The ends of the guide rails 28, 29 are provided with a bevel 43 to ensure a maximum guiding or supporting path (FIG. 3).

The upper guide of the side tabs 15 and lid side tabs 16, i.e. the guide members 32, 33, also extends or extend directly up to the gluing unit 20. For this purpose, the guide members 32, 33 are provided with an oppositely oriented bevel 44 (FIG. 3).

In the region of the gluing unit 20, the guide rails 28, 29 merge into side walls 45, 46 (FIGS. 2 and 6) which have a significantly smaller width. As a result, the glue discs 21 can operate laterally next to the side walls 45, 46. Here, the side walls 45, 46 only serve as lateral guides of the hinge-lid packs 10.

After receiving the glue, the side tabs 15 and lid side tabs 16 are folded over against the already folded inner side tabs in the usual manner, i.e. into an upright position. This folding step is conducted by means of known folding deflectors. Thereafter, the completed pack is fed to an intermediate turret 42 (FIG. 1) which feeds the packs for example to a drying turret (not illustrated).

What is claimed is:

1. In an apparatus for applying glue to outer side tabs (15) and lid side tabs (16) of a hinge-lid pack (10) consisting of a box (11) and a lid (12), said apparatus including a folding turret (13) for substantially completely folding the hinge lid pack (10) so that the outer side tabs (15) of the box and a box front panel (17) connected to the outer side tabs (15), as well as the lid side tabs (16) and a lid front panel (18) connected to the lid side tabs (16), are directed in a common horizontal plane, the improvement comprising:

a) a pack track (19) for transporting hinge-lid packs from the folding turret (13) to a gluing unit so that the box front panel (17) and the lid front panel (18) are located on top in a horizontal plane and so the outer side tabs (15) and the lid side tabs (16) are laterally directed;

b) a gluing unit (20), disposed in a region of the pack track (19), comprising glue discs (21) for applying glue to a bottom side of the outer side tabs (15) and lid side tabs (16);

c) guide rails (28, 29) for laterally guiding the hinge-lid packs, and being disposed on both sides of the hinge-lid packs (10) in a region between the folding turret (13) and said gluing unit (20), d) wherein top sides of said guide rails (28, 29) form supporting surfaces (30) for the laterally directed outer side tabs (15) and lid side tabs (16) in said horizontal plane of the box front panel (17) and the lid front panel (18);

e) upright lateral guide ribs (31), disposed on said supporting surfaces (30) of the guide rails (28, 29), for laterally guiding lateral free edges of the outer side tabs (15) and lid side tabs (16); and f) a guide web (35), disposed above a hinge-lid pack (10), which presses downward on the box front panel (17) and lid front panel (18) and which extends into said gluing unit (20) to retain the box front panel (17) and lid front panel (18) in a horizontal position.

2. The apparatus according to claim 1, wherein the guide rails (28, 29) extend into a region of the gluing unit (20) and are each provided with a bevel (43) on an end thereof which confronts the gluing unit, and wherein the bevel corresponds to a contour of said glue discs (21).

3. The apparatus according to claim 1 or 2, comprising elongated stationary rod-like upper guide members (32, 33), disposed above said guide rails (28, 29), for guiding upper surfaces of the outer side tabs (15) and lid side tabs (16) at least along part of the pack track (19) and being spaced apart from the outer side tabs (15) and lid side tabs (16).

4. The apparatus according to claim 3, wherein the guide members (32, 33) are arranged slightly inwardly offset relative to the guide rails (28, 29) to cover only portions of a box front panel (17) and a lid front panel (18).

5. The apparatus according to claim 4, wherein the guide members (32, 33) are arranged only in a region directly before said gluing unit (20).

6. The apparatus according to claim 3, wherein the guide web (35) extends over and beyond the gluing unit (20) and is provided with a recess (40) in a region of said gluing unit (20).

7. The apparatus according to claim 6, wherein said pack track (19) comprises track rails (23, 24), and wherein the guide web (35) centrally extends above said track rails (23, 24) and directly above the hinge-lid packs (10).

8. The apparatus according to claim 1 or 2, wherein the guide web (35) is mounted on lateral supports (36) arranged next to the pack track (19) and bears under gravity on an upwardly facing side of each hinge-lid pack (10) during transport of said pack.

9. The apparatus according to claim 1 or 2, further comprising two upright side walls (45, 46) acting as lateral guides for lateral edges of the hinge-lid packs (10) only in a region of the gluing unit (20), said side walls (45, 46) extending the guide rails (28, 29) and having a smaller width than said guide rails (28, 29), and each side wall (45, 46) being arranged in a region between, on the one hand, said glue discs (21) of the gluing unit (20), and, on the other hand, hinge-lid pack (10).

10. The apparatus according to claim 9, comprising elongated stationary rod-like upper guide members (32, 33), disposed above said guide rails (28, 29), for guiding upper surfaces of the outer side tabs (15) and lid side tabs (16) at least along part of the pack track (19) and being slightly spaced apart from the outer side tabs (15) and lid side tabs (16).

11. The apparatus according to claim 9, wherein each side wall (45, 46) is arranged in a region between, on the one hand, said glue discs (21) of said gluing unit (20), and, on the other hand, the outer side tabs (15) and the lid side tabs (16) of a hinge-lid pack (10).

* * * * *